US007014620B2

(12) United States Patent
Kim

(10) Patent No.: US 7,014,620 B2
(45) Date of Patent: Mar. 21, 2006

(54) LIE-DOWN MASSAGER

(76) Inventor: Hakjin Kim, 610 Ridgeview Ct., Diamond Bar, CA (US) 91765

( * ) Notice: Subject to any disclaimer, the term of this patent is extended or adjusted under 35 U.S.C. 154(b) by 463 days.

(21) Appl. No.: 10/429,345

(22) Filed: May 5, 2003

(65) Prior Publication Data

US 2004/0225240 A1 Nov. 11, 2004

(51) Int. Cl.
*A61H 15/00* (2006.01)

(52) U.S. Cl. ..... 601/99; 601/18; 601/101; 601/103; 601/116

(58) Field of Classification Search ..... 601/15, 601/18, 19, 86, 87, 90, 92–95, 97–103, 115–118, 601/122, 126; 606/240–242; 607/100; 5/617, 5/618

See application file for complete search history.

(56) References Cited

U.S. PATENT DOCUMENTS 4,422,449 A 12/1983 Hamabe
5,088,475 A * 2/1992 Steffensmeier ..... 601/116
5,179,940 A 1/1993 Barreiro
6,243,609 B1 6/2001 Lee
6,454,732 B1 9/2002 Lee
6,542,779 B1 4/2003 Lee
6,555,798 B1 4/2003 Lee
6,629,939 B1 10/2003 Jikiba
6,643,551 B1 * 11/2003 Park ..... 607/100
6,656,138 B1 * 12/2003 Kim ..... 601/19
6,837,861 B1 * 1/2005 Lin ..... 601/87
2002/0138023 A1 9/2002 Kume et al.
2002/0193713 A1 12/2002 Lee
2003/0018284 A1 1/2003 Lim

* cited by examiner

*Primary Examiner*—Gregory L. Huson
*Assistant Examiner*—Quang D. Thanh
(74) *Attorney, Agent, or Firm*—Park Law Firm; John K. Park

(57) ABSTRACT

A lie-down massager comprises a frame having an elongated top panel with an elongated opening, a rider below the top panel, a guide member movably engaged between the frame and the rider to enable the rider to make a horizontal reciprocation relative to the frame, a lifter moving vertically relative to the rider, and a roller gear engaged to the rider. The roller gear is engaged to a vertical rack gear in an opening of an engagement body extending from the lifter so the roller gear rotation enables the lifter to make a vertical reciprocation. Massage bumps attached to the top portion of the lifter move vertically and/or horizontally along the elongated top opening of the elongated top panel of the frame by the lifter and the rider.

26 Claims, 5 Drawing Sheets

LIE-DOWN MASSAGER

BACKGROUND OF THE INVENTION

The invention relates generally to a massaging device. More particularly, the present invention relates to an improved lie-down massager capable of efficiently treating bodily malfunctions such as back pain and gastrointestinal weakness by applying a therapeutic massaging treatment along the back and neck of a patient lying down on the massager whose massaging bumps move horizontally and vertically along the patient's spinal cord and neck while the vertical movement of the massaging bumps are actuated by a vertical rack gear mechanism.

Conventional bed or mat type massaging devices employ a spring mechanism for vertically moving massaging bumps. As disclosed U.S. Pat. No. 6,454,732, a spring mechanism allows the massaging bumps to gently move up and down. However, when it comes to therapeutic effects, the spring mechanism proves too soft to push up the massaging bumps when stronger pressure is required, because tension of springs applies equally to patients lying on the massaging device regardless of patient's requirements.

A demand is to adopt a reliable mechanism demonstrating a steady and robust therapeutic effects while stabilizing the vertical movement of the massaging bumps.

SUMMARY OF THE INVENTION

The present invention is contrived to overcome the conventional disadvantages. Accordingly, an object of the invention is to provide a lie-down massager that improves therapeutic effects by adopting a rack gear mechanism for a vertical movement of massaging bumps.

Another object is to stabilize the vertical movement of the massaging bumps, thereby enabling patients to receive a steady and robust massaging of the massaging bumps applied to and along their backs and necks. A further object is to improve product reliability and customer satisfaction by mechanically stabilizing the vertical movement of the massaging bumps in accordance with a rack gear construction.

To achieve these and other objects, the lie-down massager according to the present invention comprises a base frame having an elongated top panel where an elongated top opening is formed centrally and lengthwisely through the elongated top panel, a rider provided below the elongated top panel of the base frame so that a rider opening is formed vertically through the rider to define an inner periphery of the rider, a guide member movably engaged between the base frame and the rider so as to enable the rider to make a horizontally reciprocal movement relative to the base frame, and a first roller gear engaged to and powered by a first motor fixed to the rider.

A lifter has a top portion and a bottom portion where an engagement body downwardly extends from the bottom portion of the lifter. A vertically elongated body opening is formed through the engagement body to define vertical walls in the engagement body, and one of the vertical walls is configured to a vertical rack gear so that the first roller gear is rollably engaged to the vertical rack gear, whereby the roller gear rotation by the first motor enables the lifter to make a vertically reciprocal movement through the rider opening while the engagement body is movably propped by the inner periphery of the rider.

In this mechanism, massage bumps are attached to the top portion of the lifter and moving vertically and/or horizontally along the elongated top opening of the elongated top panel of the base frame, and a pad is provided cover the massage bumps and the elongated top opening of the base frame.

For a better performance, a rider may have rider guide rollers on each side thereof so the rider guide rollers are rollably engaged to the base frame to guide a horizontally reciprocal movement of the rider. A roller gear is engaged to and powered by a motor fixed to the rider. Here, a pair of pulleys are linked by a rope and respectively mounted in a front end portion and a rear end portion of the base frame where a predetermined portion of the rope is fixedly attached to the rider so that the pulley rotation enables the rider to generate a horizontally reciprocal movement of the rider.

In order to maximize therapeutic effect, a pair of roller coasters parallel to each other are attached to the base frame and above the rider guide rollers to respectively have a substantially waved top surface. A coasting member having a bottom surface and side surfaces is liftedly engaged to the rider, wherein a support in a substantially cylindrical format is fixedly formed on top of the coasting member where a coaster guide roller is formed outwardly extending from each of the side surfaces of the coasting member so that the coaster guide roller enables the coasting member to make a roller coasting movement on and along the waved top surfaces of the roller coasters while being engagedly lifted from the rider which makes the horizontally reciprocal movement.

Selectively, a support may be fixedly formed on top of the rider to provide an additional propping to the engagement body to substantially surround the engagement body so as to stabilize the vertically reciprocal movement of the engagement body. A vertical slot may be formed through the support in order for a signal bar to horizontally extend from the engagement body through the vertical slot to controllingly facilitate the vertically reciprocal movement of the lifter. A pair of limit switches respectively formed adjacent to each end of the vertical slot to further facilitate the control of the vertically reciprocal movement of the lifter.

Advantages of the present inventions include that: (1) the vertical rack gear mechanism minimizes parts required for the vertical movement of the massaging bumps by utilizing the vertical opening through the engagement body and vertical walls formed thereby one of whose wall is configured to a rack gear, while improving stability in the vertical reciprocation of the lifter carrying the massaging bumps; (2) the engagement body downwardly extending from the lifter includes the vertical rack gear therein and props the lifter thereupon while optimally cooperating with the support that detachedly props the engagement body, thereby enhancing product reliability; and (3) the coasting member working with the roller coasters to realize an additional lifting by utilizing the horizontally reciprocal movement of the rider enables the massaging bumps to continue a smooth, steady and robust massaging on the patient, thereby substantially improving massaging effect and subsequently maximizing customer satisfaction.

Although the present invention is briefly summarized, the full understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
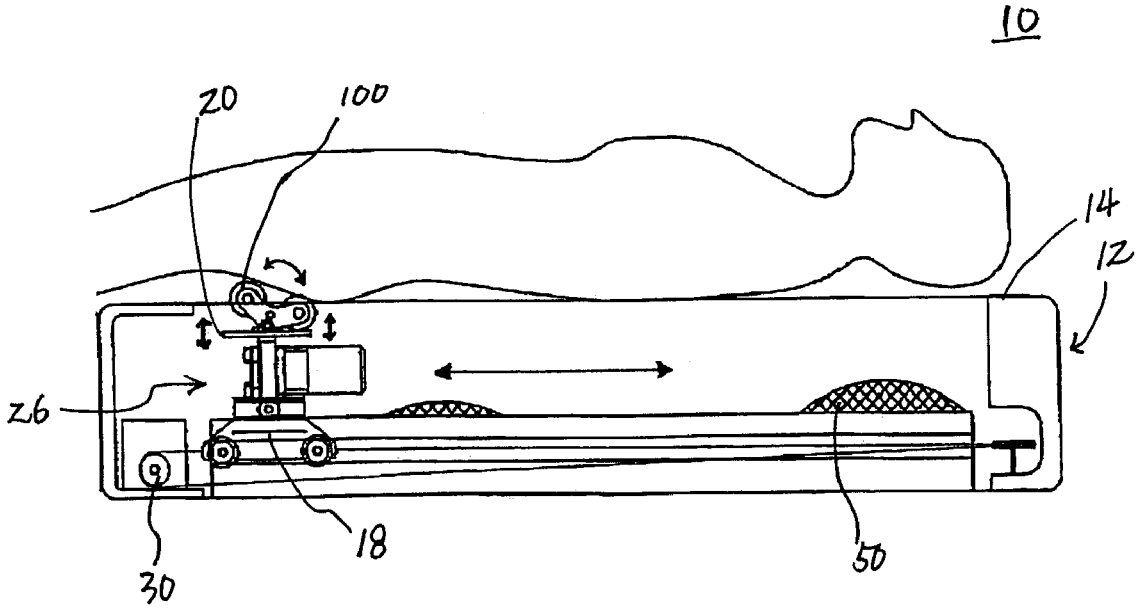
FIG. 1 is a view showing a lie-down massager with a patient lying thereon according to the present invention.
Figure 2:
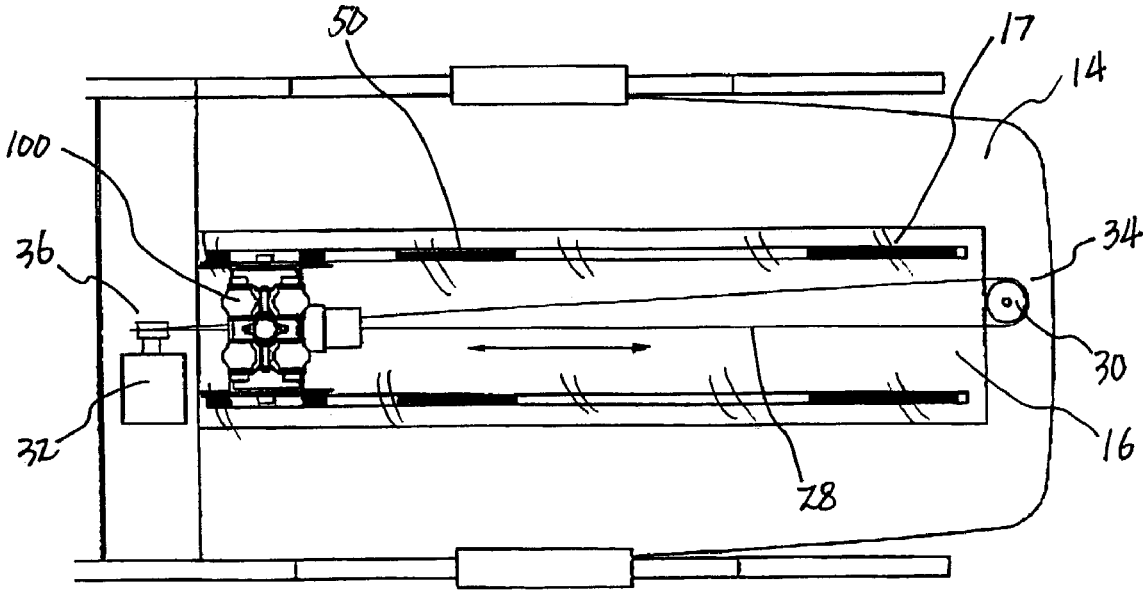
FIG. 2 is a plan view showing the lie-down massager without the patient in FIG. 1.

FIG. 1 shows a brief massaging mechanism of a lie-down massager 10 according to the present invention with a patient lying thereon for a bodily massage, and FIG. 2 shows a plan view of the massager 10 excluding the patient. As shown therein, the lie-down massager 10 includes a base frame 12 in a bed type or a mat type. The base frame 12 includes an elongated top panel 14, and an elongated opening 16 is formed centrally and lengthwisely through the elongated top panel 14. The massager 10 includes a rider 18 and a lifter 20. The rider 18 is provided below the elongated top panel 14 of the base frame 12. A rider opening 22 is formed vertically through the rider 18 to define an inner periphery 24 of the rider 18.

In order to implement the horizontal reciprocation of the rider 18, there is provided a guide member 26 movably engaged between the base frame 12 and the rider 18 so as to enable the rider 18 to make a horizontally reciprocal movement relative to the base frame 12. Here, it is recommended that he guide member 26 be either a rope-pulley application or a rack gear application.

Figure 3:
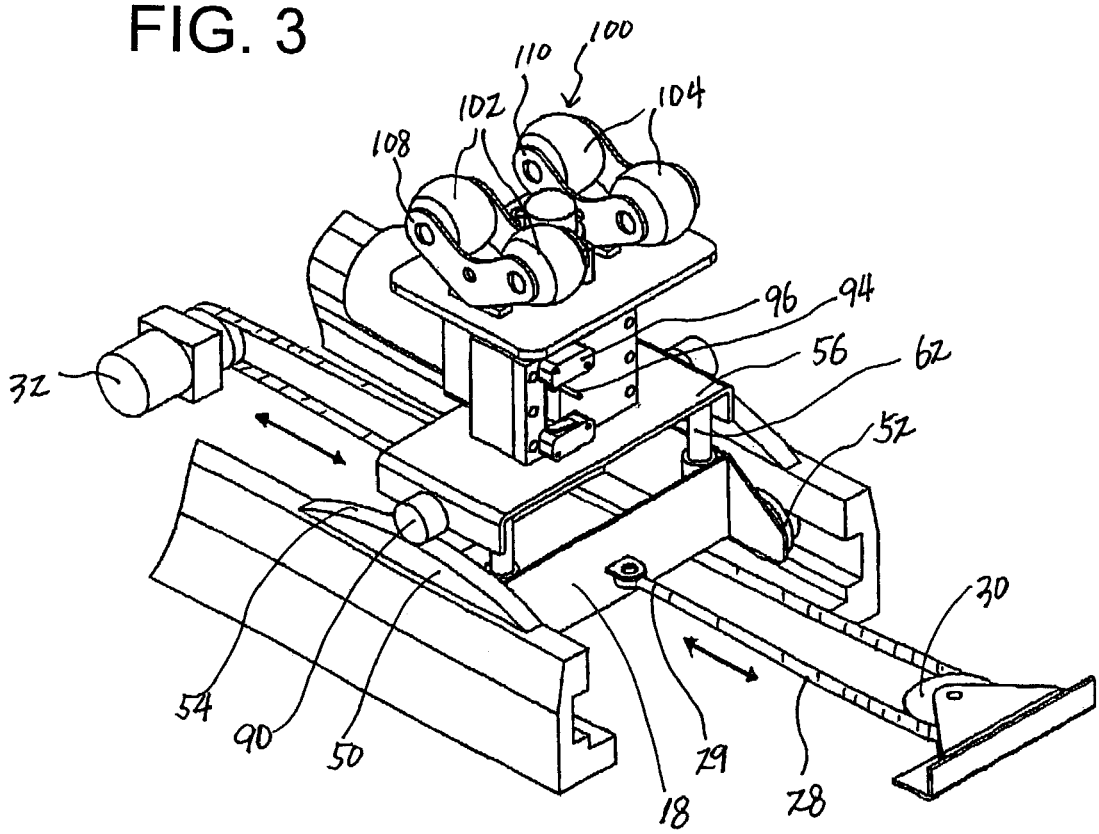
FIG. 3 is a partial perspective view showing an overall mechanism of the lie-down massager according to a first embodiment of the present invention.
Figure 4:
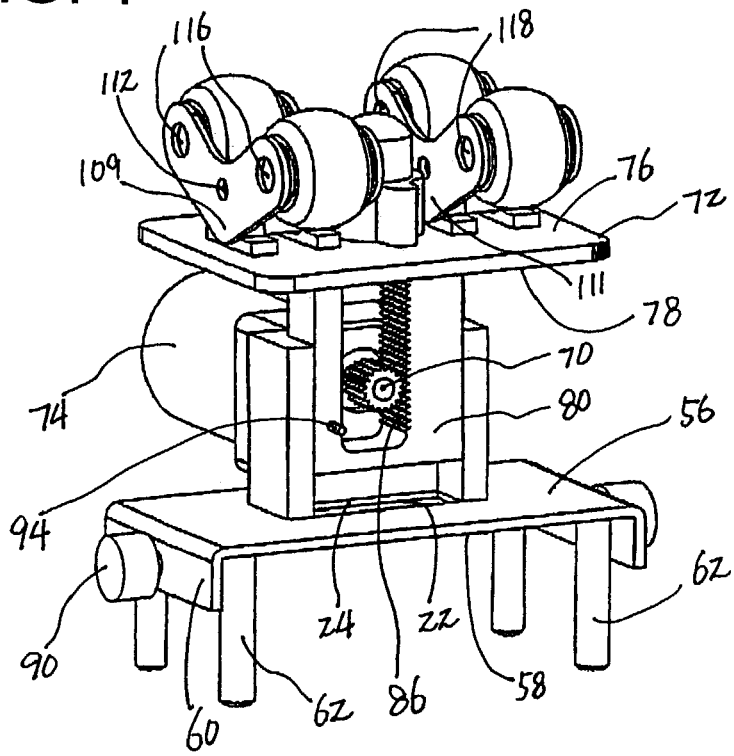
FIG. 4 is a partial perspective view showing a vertical reciprocation of a lifter in FIG. 3.

As shown in FIG. 3 together with FIG. 4, the guide member 26 according to the rope-pulley application includes a rope 28, a pair of pulleys 30 and a pulley motor 32 that controls one of the pulleys 30. The pulleys 30 are linked by the rope 28 and respectively mounted in a front end portion 34 and a rear end portion 36 of the base frame 12. In a preferred version, the pulley motor 32 is provided adjacent to the pulley 30 provided in the rear end portion 36 of the base frame 12. In this construction, a predetermined portion 29 of the rope 28 is fixedly attached to the rider 18 so that the pulley rotation enables the rider 18 to generate a horizontally reciprocal movement of the rider 18. Preferably, the pulleys 30 are relatively twisted by 90 degrees against each other to facilitate the horizontal reciprocation of the rider 18 while improving controllability of the rider reciprocation.

Figure 5:
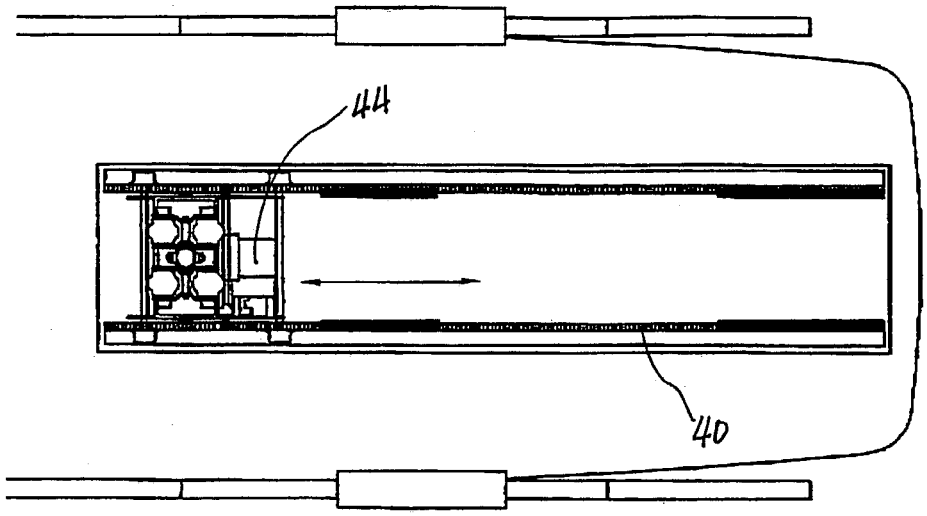
FIG. 5 is a partial plan view showing a second embodiment of the present invention.
Figure 6:
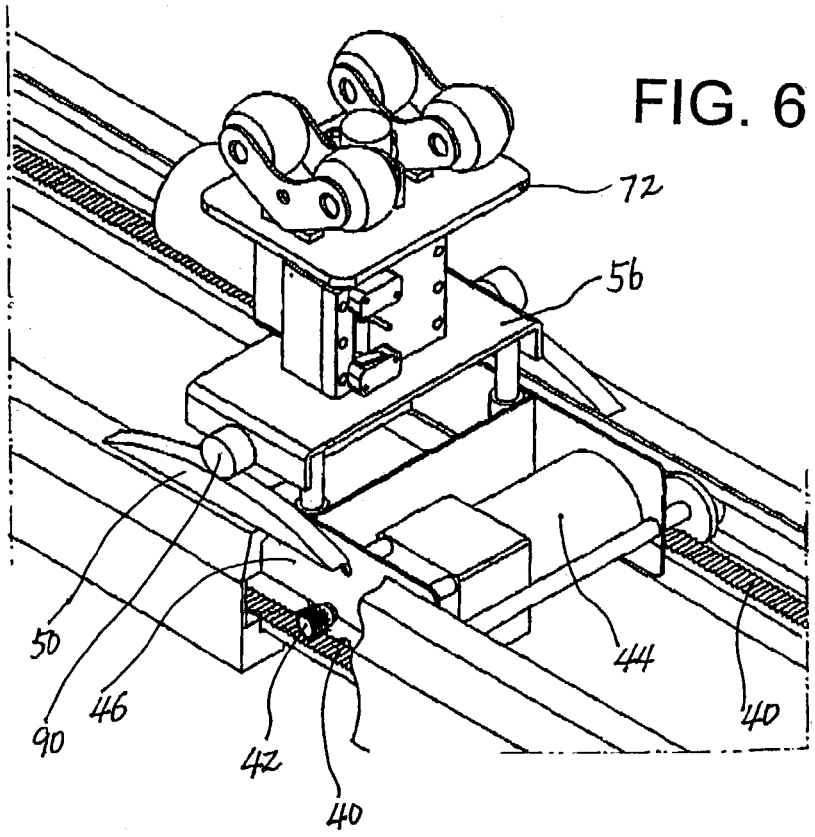
FIG. 6 is a partial perspective view showing the mechanism according to the second embodiment of the present invention.
Figure 7:
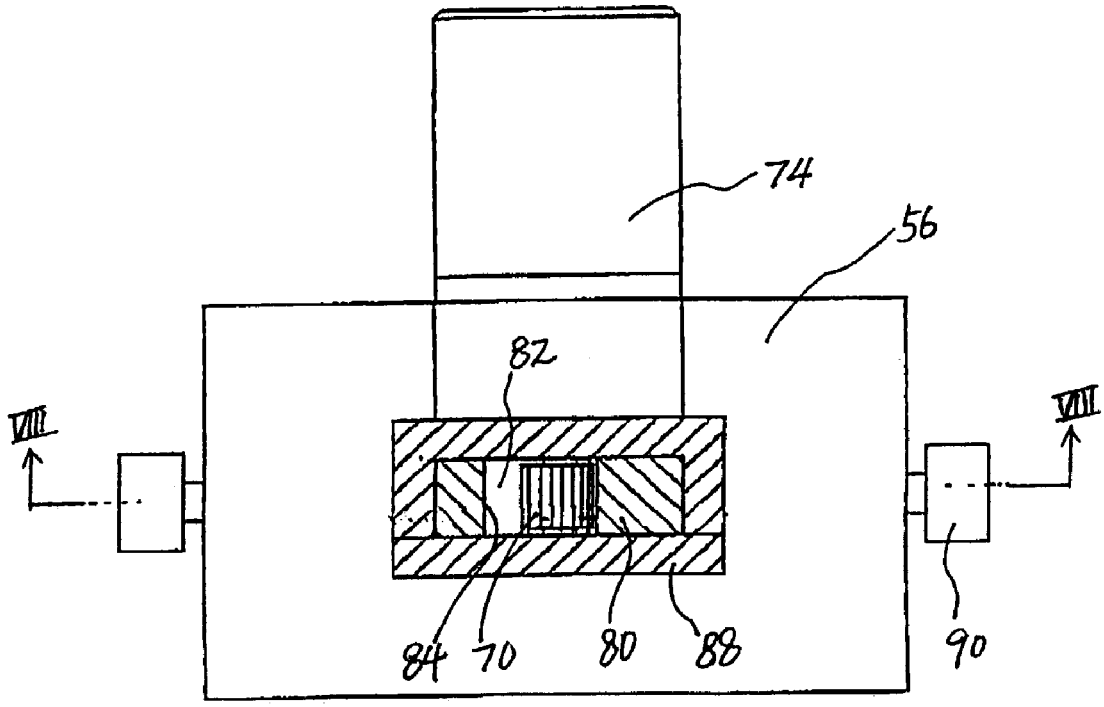
FIG. 7 is a vertical rack mechanism according to the present invention.
Figure 8:
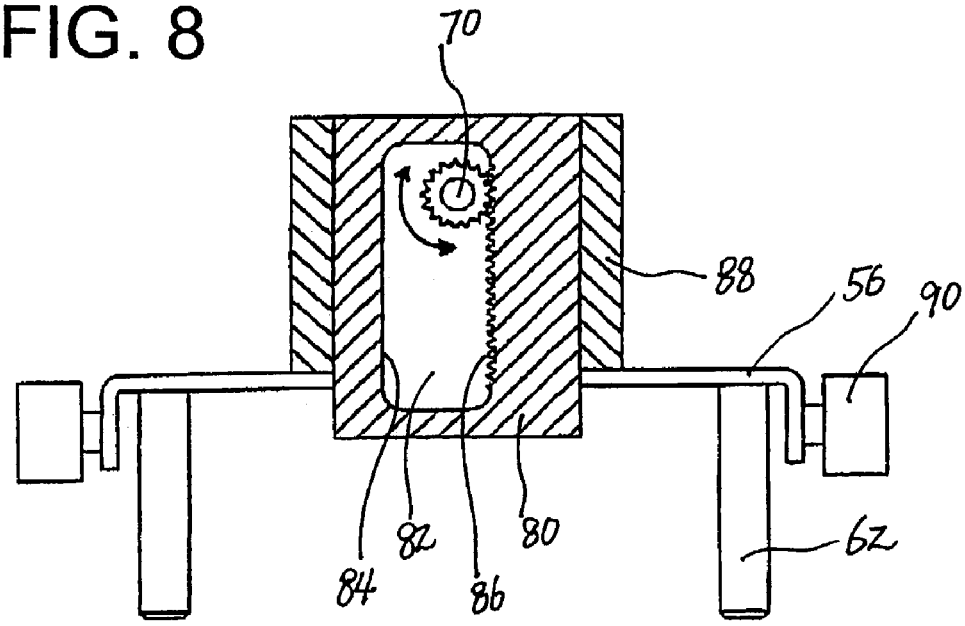
FIG. 8 is a cross-sectional view taken along line VIII—VIII in FIG. 5.
Figure 9A:
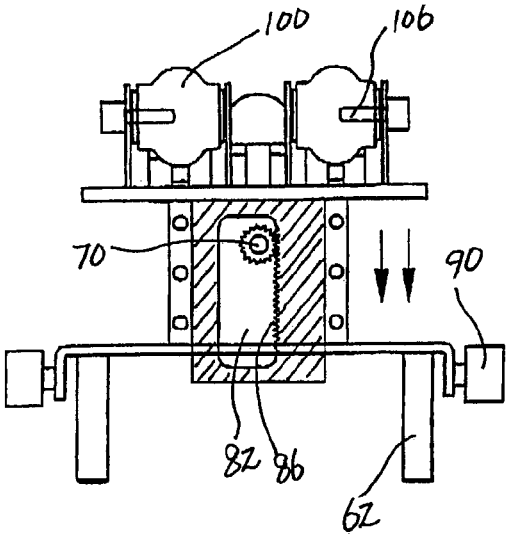
FIGS. 9A–9D are views showing a vertical rack mechanism of the lie-down massager according to the present invention.
Figure 9B:
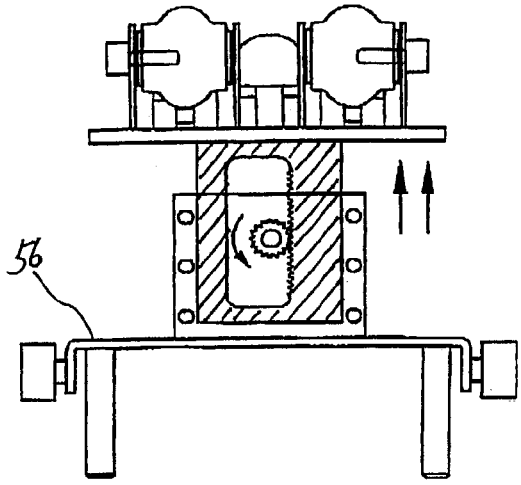
Figure 9C:
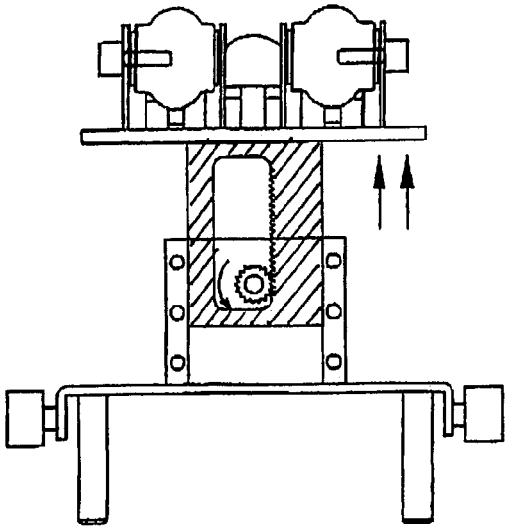
Figure 9D:
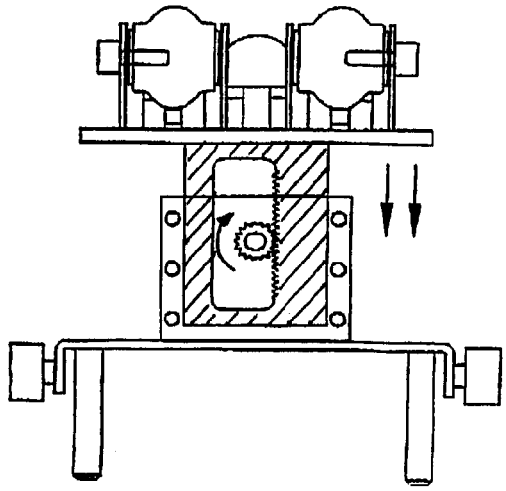

Meanwhile, FIGS. 5 and 6 respectively illustrate the rack gear application for the horizontal reciprocation of the rider 18. As shown therein, the guide member 26 employing the rack gear application includes a pair of side rack gears 40 parallel to each other and lengthwisely provided in the base frame 12, a roller gear 42 perpendicular to the side rack gears 40, and a motor 44 to power the roller gear 42. The roller gear 42 is rollably connected to a rider 46 and rotatably mounted on the side rack gears 40.

To accelerate massaging effect, the massager 10 includes a pair of roller coasters 50 parallel to each other. The roller coasters 50 are attached to the base frame 12 and above the rider guide rollers 52 formed on each side of the rider 18. The rider guide rollers 52 are rollably engaged to the base frame 12 to guide a horizontally reciprocal movement of the rider 18. That is, the roller coasters 50 are formed on each side of the base frame 12. Here, the roller coasters 50 each have a substantially waved top surface 54. It is preferred that the waved top surfaces 54 of the roller coasters 50 each substantially form a curvature of a human spinal cord. In order to utilize the roller coasters 50, there is provided a coasting member 56 having a bottom surface 58 and side surfaces 60. Preferably, the coasting member 56 is liftedly engaged to the rider 18. Specifically, elongated guides 62 downwardly extend from the bottom surface 58 of the coasting member 56, and guide bushes 64 are upwardly formed on the rider 18 to releasably receive the elongated guides 62 so as to stabilize the roller coasting movement of the coasting member 56 along the roller coasters 50 and the lifting of the coasting member 56 from the rider 18. Preferably, the elongated guides 62 are shaped in pins.

With reference to FIGS. 3–4, 7–8 and 9A–9D each illustrating the vertical rack gear mechanism of the lie-down massager 10, there is provided a roller gear 70 for lifting a lifter 20 engaged to and powered by a motor 74 which is fixed either to the rider 18 when the rider incorporates the coasting member 56 or to the coasting member 56 liftedly mounted on the rider 18. Here, the lifter 20 has a top portion 76 and a bottom portion 78, and an engagement body 80 downwardly extends from the bottom portion 78 of the lifter 20. A vertically elongated body opening 82 is formed through the engagement body 80 to define vertical walls 84 in the engagement body 80. In this configuration, one of the vertical walls 84 is configured to a vertical rack gear 86 so that the roller gear 70 is rollably engaged to the vertical rack gear 86, whereby the roller gear rotation by the motor 74 enables the lifter 20 to make a vertically reciprocal movement through the rider opening 22 while the engagement body 80 is movably propped by the inner periphery 24 of the coasting member 56 or the rider 18.

In order to stabilize the vertical reciprocation of the lifter 20, a support 88 in a substantially cylindrical format is fixedly formed on top of the coasting member 56 or the rider 18 when incorporated with the coasting member 56. A coaster guide roller 90 is formed outwardly extending from each of the side surfaces 60 of the coasting member 56. The coaster guide roller 90 enables the coasting member 56 to make a roller coasting movement on and along the waved top surfaces 54 of the roller coasters 50 while being engagedly lifted from the rider 18 which makes the horizontally reciprocal movement. The support 88 eventually serves to provide an additional propping to the engagement body 80. In preferred version, the support 88 substantially surrounds the engagement body 80 to stabilize the vertically reciprocal movement of the engagement body 80.

To cooperate with the support 88, a vertical slot 92 may be selectively formed through the support 88, and a signal bar 94 horizontally extends from the engagement body 80 through the vertical slot 92 to controllingly facilitate the vertically reciprocal movement of the lifter 20. There may be further provided a pair of limit switches 96 respectively formed adjacent to each end of the vertical slot 92 to further facilitate the control of the vertically reciprocal movement of the lifter 20.

In order to finally apply the vertical rack mechanism to a patient lying on the massager 10, there are provided massage bumps 100 attached to the top portion 76 of the lifter 20 and moving vertically and/or horizontally along the elongated top opening 16 of the elongated top panel 14 of the base frame 12. Optionally, a pad 17 may be provided to cover the massage bumps 100 and the elongated top opening 16 of the base frame 12. The massage bumps 100 are preferably partitioned to first and second pairs 102, 104. Here, the first pair bumps 102 are aligned parallel to the second pair bumps 104. The massage bumps 100 each include a heater 106 which can be a heating lamp generating heat and infrared rays.

To further improve massaging effect, there are provided first and second bump holders 108, 110 propping and maintaining the first and second pair bumps 102, 104 above the top portion 76 of the lifter 20. For a better massaging result, there are further provide first and second bump holders 108, 110 tapered toward each lower end 109, 111 thereof, a first engagement member 112, 114 to rockingly engage the lower ends 109, 111 of the bump holders 108, 110 to the top portion 76 of the lifter 20, and a second engagement member 116, 118 to rollingly engage the massage bumps 100 thereto. The massage bumps 100 may be roller balls formed of precious stone such as jade.

As discussed above, an advantages of the present inventions is that the vertical rack gear mechanism minimizes parts required for the vertical movement of the massaging bumps 100 by utilizing the vertical opening 82 through the engagement body 80 and vertical walls 84 formed thereby one of whose wall 84 is configured to the rack gear 86 engaged to the roller gear 70 for generation of the vertical reciprocation of the lifter 20, while improving stability in the vertical reciprocation of the lifter 20 carrying the massaging bumps 100 thereon.

In addition, the engagement body 80 downwardly extending from the lifter 20 includes the vertical rack gear 86 therein and props the lifter 20 thereupon while optimally cooperating with the support 88 that detachedly props the engagement body 80, thereby enhancing product reliability. Further, the coasting member 56 working with the roller coasters 50 to realize an additional lifting by utilizing the horizontally reciprocal movement of the rider 18 enables the massaging bumps 100 to continue a smooth, steady and robust massaging on the patient, thereby substantially improving massaging effect and subsequently maximizing customer satisfaction.

Although the invention has been described in considerable detail, other versions are possible by converting the aforementioned construction. Therefore, the scope of the invention shall not be limited by the specification specified above and the appended claims.

What is claimed is:

1. A lie-down massager, comprising:

a) a base frame having an elongated top panel, wherein an elongated top opening is formed centrally and lengthwisely through the elongated top panel;

b) a rider provided below the elongated top panel of the base frame, wherein a rider opening is formed vertically through the rider to define an inner periphery of the rider;

c) a guide member movably engaged between the base frame and the rider so as to enable the rider to make a horizontally reciprocal movement relative to the base frame;

d) a first roller gear engaged to and powered by a first motor, wherein the first motor is fixed to the rider;

e) a lifter having a top portion and a bottom portion, wherein an engagement body downwardly extends from the bottom portion of the lifter, wherein a vertically elongated body opening is formed through the engagement body to define vertical walls in the engagement body, wherein one of the vertical walls is configured to a vertical rack gear so that the first roller gear is rollably engaged to the vertical rack gear, whereby the roller gear rotation by the first motor enables the lifter to make a vertically reciprocal movement through the rider opening while the engagement body is movably propped by the inner periphery of the rider;

f) massage bumps attached to the top portion of the lifter and moving vertically and/or horizontally along the elongated top opening of the elongated top panel of the base frame; and g) a pad covering the massage bumps and the elongated top opening of the base frame.

2. The lie-down massager of claim 1 wherein the guide member comprises:

a) a pair of side rack gears parallel to each other and lengthwisely provided in the base frame;

b) a second roller gear perpendicular to the side rack gears, wherein the second roller gear is rollably connected to the rider and rotatably mounted on the side rack gears; and c) a second motor to power the second roller gear.

3. The lie-down massager of claim 1 further comprising a support fixedly formed on top of the rider to provide an additional propping to the engagement body, wherein the support substantially surrounds the engagement body to stabilize the vertically reciprocal movement of the engagement body.

4. The lie-down massager of claim 3 wherein a vertical slot is formed through the support, wherein a signal bar horizontally extends from the engagement body through the vertical slot to controllingly facilitate the vertically reciprocal movement of the lifter.

5. The lie-down massager of claim 4 further comprising a pair of limit switches respectively formed adjacent to each end of the vertical slot to further facilitate the control of the vertically reciprocal movement of the lifter.

6. The lie-down massager of claim 1 wherein the massage bumps are partitioned to first and second pairs, wherein the first pair bumps are aligned parallel to the second pair bumps.

7. The lie-down massager of claim 1 wherein the massage bumps each include a heater.

8. The lie-down massager of claim 7 wherein the heater is a heating lamp generating heat and infrared rays.

9. The lie-down massager of claim 6 further comprising:

a) first and second bump holders propping and maintaining the first and second pair bumps above the top portion of the lifter, wherein the first and second bump holders are tapered toward each lower end thereof; and b) a first engagement member to rockingly engage the lower ends of the bump holders to the top portion of the lifter.

10. The lie-down massager of claim 9 further comprising a second engagement member to rollingly engage the massage bumps thereto.

11. The lie-down massager of claim 9 wherein the massage bumps are roller balls.

12. The lie-down massager of claim 11 wherein the roller balls are formed of jade.

13. A lie-down massager, comprising:

a) a base frame having an elongated top panel, wherein an elongated top opening is formed centrally and lengthwisely through the elongated top panel;

b) rider provided below the elongated top panel and having rider guide rollers on each side thereof, wherein the rider guide rollers are rollably engaged to the base frame to guide a horizontally reciprocal movement of the rider;

c) a roller gear engaged to and powered by a motor, wherein the motor is fixed to the rider;

d) a pair of pulleys linked by a rope and respectively mounted in a front end portion and a rear end portion of the base frame, wherein a predetermined portion of the rope is fixedly attached to the rider so that the pulley rotation enables the rider to generate a horizontally reciprocal movement of the rider;

e) a pair of roller coasters parallel to each other, wherein the roller coasters are attached to the base frame and above the rider guide rollers, wherein the roller coasters each have a substantially waved top surface;

f) a coasting member having a bottom surface and side surfaces, wherein the coasting member is liftedly engaged to the rider, wherein a support in a substantially cylindrical format is fixedly formed on top of the coasting member, wherein a coaster guide roller is formed outwardly extending from each of the side surfaces of the coasting member, wherein the coaster guide roller enables the coasting member to make a roller coasting movement on and along the waved top surfaces of the roller coasters while being engagedly lifted from the rider which makes the horizontally reciprocal movement;

g) a lifter having a top portion and a bottom portion, wherein an engagement body downwardly extends from the bottom portion of the lifter, wherein a vertically elongated body opening is formed through the engagement body to define vertical walls in the engagement body, wherein one of the vertical walls is configured to a rack gear so that the roller gear is rollably engaged to the rack gear, whereby the roller gear rotation by the motor enables the lifter to make a vertically reciprocal movement through the rider opening while the engagement body is movably propped by the support;

h) massage bumps attached to the top portion of the lifter and moving vertically and/or horizontally along the elongated top opening of the elongated top panel of the base frame; and i) a pad covering the massage bumps and the elongated top opening of the base frame.

14. The lie-down massager of claim 13 further comprises:

a) elongated guides extending from the bottom surface of the coasting member; and b) guide bushes upwardly formed on the rider to releasably receive the elongated guides so as to stabilize the roller coasting movement of the coasting member along the roller coasters and the lifting of the coasting member from the rider.

15. The lie-down massager of claim 14 wherein the elongated guides are shaped in pins.

16. The lie-down massager of claim 13 wherein a vertical slot is formed through the support, wherein a signal bar horizontally extends from the engagement body through the vertical slot to controllingly facilitate the vertically reciprocal movement of the lifter.

17. The lie-down massager of claim 16 further comprising a pair of limit switches respectively formed adjacent to each end of the vertical slot to further facilitate the control of the vertically reciprocal movement of the lifter.

18. The lie-down massager of claim 13 wherein the massage bumps are partitioned to first and second pairs, wherein the first pair bumps are aligned parallel to the second pair bumps.

19. The lie-down massager of claim 13 wherein the massage bumps each include a heater.

20. The lie-down massager of claim 19 wherein the heater is a heating lamp generating heat and infrared rays.

21. The lie-down massager of claim 18 further comprising:

a) first and second bump holders propping and maintaining the first and second pair bumps above the top portion of the lifter, wherein the first and second bump holders are tapered toward each lower end thereof; and b) a first engagement member to rockingly engage the lower ends of the bump holders to the top portion of the lifter.

22. The lie-down massager of claim 21 further comprising a second engagement member to rollingly engage the massage bumps thereto.

23. The lie-down massager of claim 21 wherein the massage bumps are roller balls.

24. The lie-down massager of claim 23 wherein the roller balls are formed of jade.

25. The lie-down massager of claim 13 wherein the waved top surfaces of the roller coasters each substantially form a curvature of a human spinal cord.

26. The lie-down massager of claim 13 wherein the pulleys are relatively twisted by 90 degrees against each other.

* * * * *